United States Patent [19]

Kimoto

[11] Patent Number: 5,076,414

[45] Date of Patent: Dec. 31, 1991

[54] COIN DISCRIMINATING AND COUNTING APPARATUS

[75] Inventor: Toyoki Kimoto, Urawa, Japan

[73] Assignee: Laurel Bank Machines Co., Ltd., Tokyo, Japan

[21] Appl. No.: 526,633

[22] Filed: May 22, 1990

[30] Foreign Application Priority Data

May 24, 1989 [JP] Japan ..... 1-130961
May 25, 1989 [JP] Japan ..... 1-132443
May 10, 1990 [JP] Japan ..... 2-120484

[51] Int. Cl.[5] ..... G07D 9/04; G07D 5/08

[52] U.S. Cl. ..... 194/317; 194/334; 453/32

[58] Field of Search ..... 194/317, 318, 319, 334, 194/338; 453/3, 4, 7, 32

[56] References Cited

U.S. PATENT DOCUMENTS 4,082,099 4/1978 Iwersen ..... 453/4
4,531,625 7/1985 Yonekura et al. ..... 453/4 X
4,681,204 7/1987 Zimmermann ..... 453/32 X
4,904,223 2/1990 Sentoku ..... 453/7

FOREIGN PATENT DOCUMENTS 3833915 4/1989 Fed. Rep. of Germany ..... 453/7
63-67714 12/1988 Japan .

*Primary Examiner*—F. J. Bartuska
*Attorney, Agent, or Firm*—Fleit, Jacobson, Cohn, Price, Holman & Stern

[57] ABSTRACT

A coin discriminating and counting apparatus including a light emitter disposed linewise in the direction perpendicular to a coin transporting direction on one side of a coin passage with respect to the vertical direction, a sensor array disposed so as to be opposite to the light emitter on the other side of the coin passage, a magnetic sensor for detecting magnetic properties of coins, the magnetic sensor being disposed so that the coin passage and the sensor array are disposed therebetween with respect to the vertical direction, an optical data memory for storing optical data detected by the sensor array, a magnetic data memory for storing magnetic data detected by the magnetic sensor, a coin diameter detector for detecting diameters of coins based upon the optical data stored in the optical data memory, a denomination discriminator for discriminating coin denominations based upon the coin diameters detected by the coin diameter discriminator, a reference magnetic data memory for storing reference magnetic data for respective denominations, a discriminator for discriminating the denominations, currency and the like of the coins by comparing the magnetic data detected when the center portion of the coin passes the magnetic sensor and output from the magnetic data memory with the reference magnetic data output from the reference magnetic data memory, and a counter for counting the value and/or number of coins based upon the results of discrimination in the denomination discriminator and the discriminator.

20 Claims, 9 Drawing Sheets

COIN DISCRIMINATING AND COUNTING APPARATUS

BACKGROUND OF THE INVENTION

The present invention relates to a coin discriminating and counting apparatus, and, particularly, to such an apparatus which can be made small in size, discriminate the denominations and currency (whether or not currently in circulation), and the like of coins and count the value and/or the number of coins for respective denominations of coins with high accuracy.

DESCRIPTION OF THE PRIOR ART

In a coin processing machine such as a coin wrapping machine or automatic vending machine, it is indispensable to discriminate the denominations, currency and the like of deposited coins and to count the number of the coins in accordance with their denominations. Therefore, these machines are provided with a coin discriminating and counting apparatus for discriminating the denominations, currency and the like of deposited coins, and counting the number of the coins for respective denominations thereof.

As this kind of the coin discriminating and counting apparatus, there is well known a coin discriminating and counting apparatus which uses a magnetic sensor to detect the materials of coins from their magnetic properties and optically detects the diameters of coins by a sensor array disposed linewise in the direction perpendicular to that of a coin passage, thereby to discriminate the denominations, currency and the like of coins, and count the number of coins for respective denominations.

As described above, in this coin discriminating and counting apparatus including the magnetic sensor and the sensor array, after magnetic data and optical data have been detected by the magnetic sensor and the sensor array for a given coin and stored in a magnetic memory and an optical memory, it is essential when using the stored magnetic and optical data for discriminating the denomination, currency and the like of the coin to accurately select from among such data stored in the memories for a number of coins that particular magnetic data and optical data relating to the coin being discriminated.

In an automatic vending machine, it is not so difficult to specify the magnetic data and the optical data detected for one and the same coin, since coins are deposited at relatively long time intervals. However, in a coin discriminating and counting apparatus for a coin processing machine such as a coin wrapping machine, a coin receiving machine or the like, it is not so easy to specify the magnetic data and the optical data detected for the same coin, since coins are fed at short and variable time intervals. Moreover, coins can be fed in reverse when coin jamming occurs. Therefore, various attempts have been made for solving this problem.

For instance, Japanese Patent Publication No. Sho 6367714 proposes a coin discriminating and counting apparatus in which there are provided in a coin passage a magnetic sensor comprising first coils and second coils for discriminating the materials of coins from their magnetic properties and a sensor array disposed downstream of the magnetic sensor and linewise in the direction perpendicular to the coin transporting direction so as to be positioned at a position where when it detects the leading edge portion of coin having the smallest diameter, the coin can be still detected by the magnetic sensor and in which change in the magnetic field produced by passage of the coin is detected by the magnetic sensor to be stored in a memory and the diameter of the coin is detected by the sensor array, whereby the denominations, currency and the like of the coin are discriminated based upon the maximum value of change in the magnetic field detected by the magnetic sensor and stored in the memory and the coin diameter detected by the sensor array.

However, in this coin discriminating and counting apparatus, since there are provided the magnetic sensor upstream and the sensor array downstream and the positional relationship therebetween is set so that when the sensor array detects the leading edge portion of coin to be discriminated, the coin is still detected by the magnetic sensor, the length of coin passage for discriminating coins is increased and there arises a problem that the coin discriminating and counting apparatus cannot be made small in size.

Further, it is necessary for a coin discriminating and counting apparatus in which the denominations, currency and the like of coins are discriminated by detecting the magnetic properties and diameters of the coins to discriminate the coin material based upon the degree of change in the magnetic field produced when the center portion of the coin passes in order to discriminate the denominations, currency of coins with the highest accuracy, since change in the magnetic field is maximum at the coin center. However, in this prior art coin discriminating and counting apparatus, since the detection of the magnetic properties of the coins is completed immediately after the sensor array detects the leading edge portion of the smallest coins and discrimination of the coin materials is merely made based upon the maximum value of change in the magnetic field detected by the magnetic sensor and stored in the memory until the sensor array detects the leading edge portion of the smallest coins, it cannot not be ensured that the maximum value represents the magnetic property of the coin detected when the center portion of the coin passes and, therefore, it is difficult to discriminate the denominations, currency and the like of coins with sufficiently high accuracy. Particularly, since the maximum value of change in the magnetic field is not often obtained for coins that are not current, such as counterfeit coins or foreign coins, when the center portion thereof passes, there is a problem that such coins cannot be discriminated with high accuracy.

Although these problems can be solved by disposing the magnetic sensor and the sensor array and close to each other, it is difficult to make the sensor array sufficiently small in size and, therefore, it has been considered impossible to dispose the magnetic sensor and the sensor array sufficiently close to each other.

SUMMARY OF THE INVENTION

It is, therefore, an object of the present invention to provide a coin discriminating and counting apparatus which can be made small in size, discriminate the denominations, currency and the like of coins, and count the value and/or the number of coins for respective denominations with high accuracy.

The above and other objects of the present invention can be accomplished by a coin discriminating and counting apparatus comprising a coin transporting means for transporting coins in a coin passage, a light emitting means disposed linewise in the direction perpendicular to the coin transporting direction on one side of the coin passage with respect to the vertical direction, a sensor array disposed so as to be opposite to said light emitting means on the other side of the coin passage, a magnetic sensor means for detecting magnetic properties of coins, said magnetic sensor means being disposed so that said coin passage and said sensor array are disposed therebetween with respect to the vertical direction, an optical data memory means for storing optical data detected by said sensor array, a magnetic data memory means for storing magnetic data detected by said magnetic sensor means, a coin diameter detecting means for detecting diameters of coins based upon the optical data stored in said optical data memory means, outputting coin diameter detection signals to said magnetic memory means thereby to enable the same to output to a discriminating means the magnetic data detected when the diameter of coins was detected and simultaneously outputting said coin diameter detection signals to a denomination discriminating means thereby to enable the same to discriminate the denominations, currency and the like of coins, a reference magnetic data memory means for storing reference magnetic data for respective denominations and outputting the reference magnetic data to said discriminating means in accordance with denomination discriminating signals from said denomination discriminating means, the discriminating means for discriminating the denominations, currency and the like of coins based upon said denomination discriminating signals output from said denomination discriminating means, said magnetic data output from said magnetic data memory means and said reference magnetic data output from said reference magnetic data memory means, and a counter means for calculating and storing the number of coins for respective denominations based upon discriminating signals output from said discriminating means.

In a preferred aspect of the present invention, said sensor array and said magnetic sensor means are disposed offset with respect to the direction of said coin passage and a coin transporting direction discriminating means is further provided for discriminating the direction of coins transported and a control means for, when said sensor array detects optical data equal to a first predetermined value, enabling said optical data memory means to start storing the optical data input from said sensor array and simultaneously enabling said magnetic data memory means to start storing the magnetic data input from said magnetic sensor means as wall as to output the magnetic data M1 input from said magnetic sensor means at that time to said coin transporting direction discriminating means and when the sensor array detects the optical data equal to the first predetermined value again, enabling the optical data memory means to stop storing the optical data and simultaneously enabling the magnetic data memory means to stop storing the magnetic data as well as to output the magnetic data M2 input from said magnetic sensor means at that time to said coin transporting direction discriminating means and when said sensor array detects the optical data equal to a second predetermined value not greater than the first predetermined value after it detected the optical data equal to the first predetermined value once, enabling said coin diameter detecting means to start detecting the coin diameter and enabling said coin transporting direction discriminating means to discriminate the coin transporting direction by comparing the magnitude between the magnetic data M1 and M2 input from said magnetic data memory means and output the result of discrimination to said counter means or said discriminating means.

In another preferred aspect of the present invention, the coin discriminating and counting apparatus further includes a coin passing position detecting means for detecting, based upon the optical data stored in said optical data memory means, the position with respect of the widthwise direction of the coin passage where the coin passes between said light emitting means and said sensor array and outputting a coin passing position detection signal to said reference magnetic data memory means and the reference magnetic data memory means stores reference magnetic data for respective denominations obtained in accordance with the position with respect to the widthwise direction of the coin passage where the coin passes and outputs the reference magnetic data selected based upon the denomination discriminating signal from said denomination discriminating means and the coin passing position detection signal from said coin passing position detecting means to said discriminating means.

In a further preferred aspect of the present invention, the coin discriminating and counting apparatus further includes a coin passing position detecting means for detecting, based upon the optical data stored in said optical data memory means, the position with respect of the widthwise direction of the coin passage where the coin passes between said light emitting means and said sensor array and a reference magnetic data correcting means for correcting the reference magnetic data output from said reference magnetic data memory means based upon a coin passing position detection signal output from said coin passing position detecting means thereby to output the thus corrected reference magnetic data to said discriminating means.

In a further preferred aspect of the present invention, the coin discriminating and counting apparatus further includes a coin passing position detecting means for detecting, based upon the optical data stored in said optical data memory means, the position with respect of the widthwise direction of the coin passage where the coin passes between said light emitting means and said sensor array and a magnetic data correcting means for correcting the magnetic data output from said magnetic data memory means based upon a coin passing position detection signal output by said coin passing position detecting means thereby to output the thus corrected magnetic data to said discriminating means.

The above and other objects and features of the present invention will become apparent from the following description made with reference to the accompanying drawings.

DESCRIPTION OF THE PREFERRED EMBODIMENTS

Figure 1:
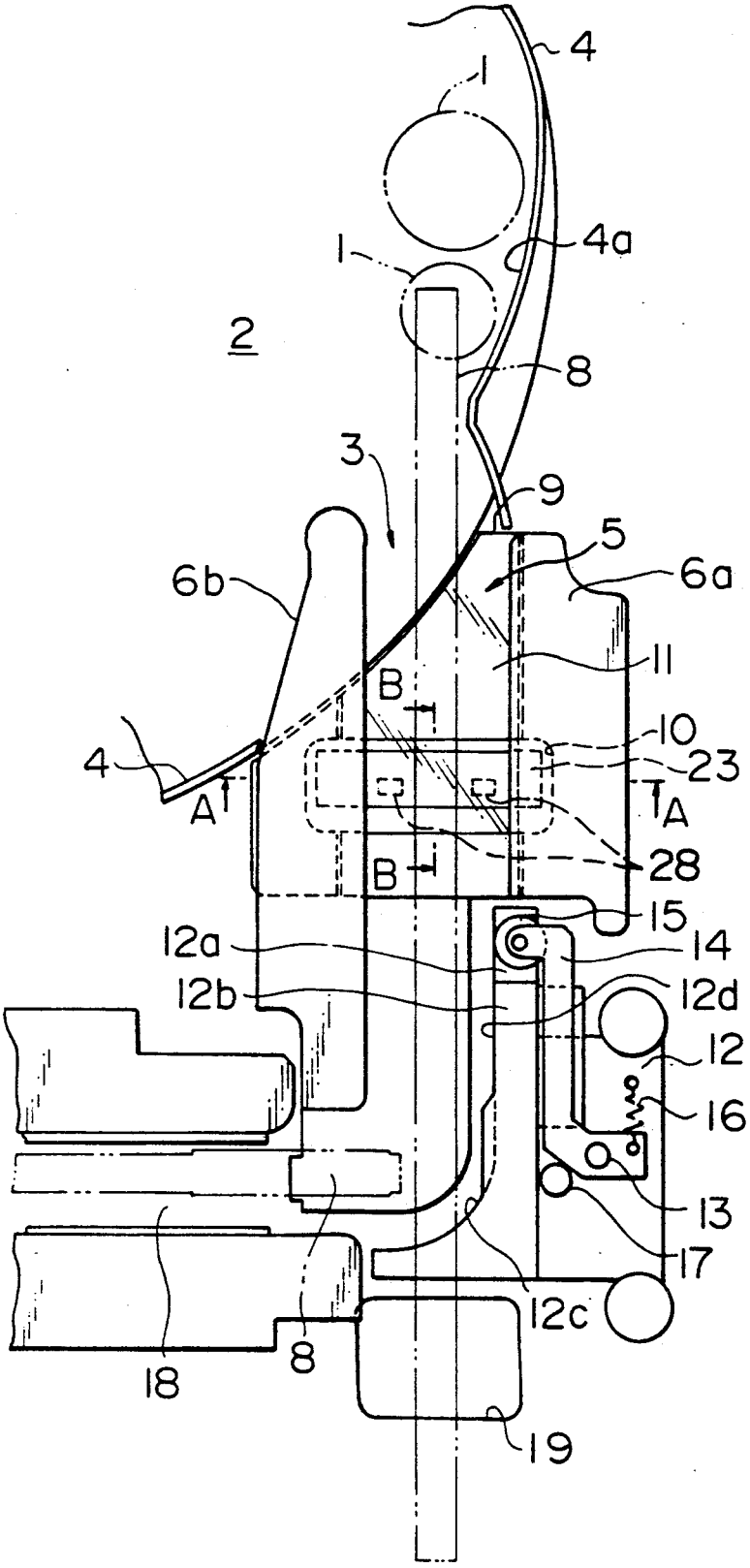
FIG. 1 is a schematic drawing showing a plan view of a coin discriminating and counting apparatus which is an embodiment of the present invention.
Figure 2:
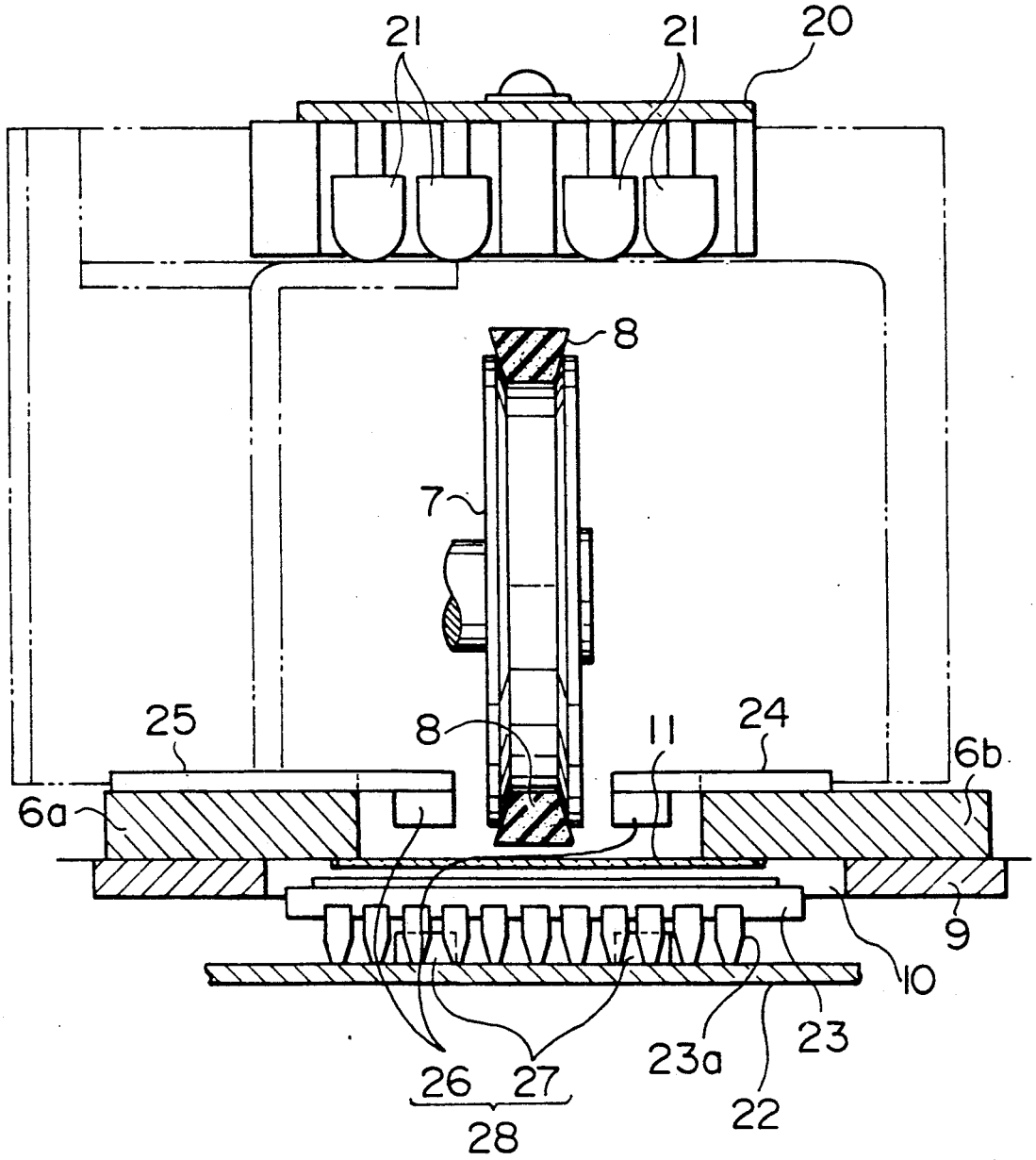
FIG. 2 is a schematic drawing showing a cross-sectional view taken on line A—A of FIG. 1.
Figure 3:
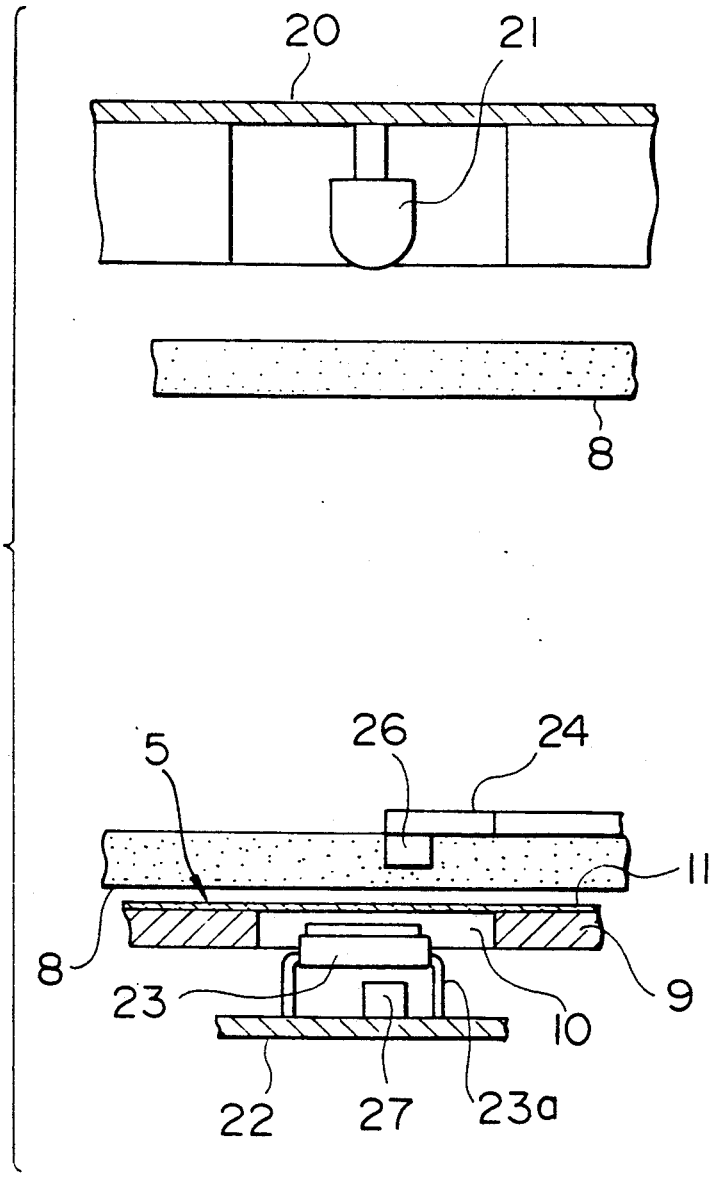
FIG. 3 is a schematic drawing showing a cross-sectional view taken on line B—B of FIG. 1.

In FIGS. 1 to 3, a coin discriminating and counting apparatus provided in a coin wrapping machine is shown. FIG. 1 is schematic drawing showing the coin discriminating and counting apparatus which is an embodiment of the present invention, FIG. 2 is a schematic drawing showing a cross-sectional view taken on line A—A thereof and FIG. 3 is a schematic drawing showing a cross-sectional view taken on line B—B thereof.

Referring to FIGS. 1 and 2, coins 1 deposited through a depositing section (not shown) are fed onto a rotatable disc 2 by a transporting mechanism (not shown). The coins 1 fed onto the rotatable disc 2 includes coins of various denominations and sometimes counterfeit coins, foreign coins or other coins not currently in use. At the periphery portion of the rotatable disc 2, there is provided an annular guide 4 formed with an opening 3. The coins 1 are fed along the inner face of the annular guide 4 by a centrifugal force produced by rotation of the rotatable disc 2 into a coin passage 5 connected to the opening 3.

On the opposite sides of the coin passage 5, there are provided a pair of guide members 6*a*, 6*b*, the space therebetween being adjustable so that the largest diameter coins to be wrapped can pass therebetween, and the space of the opening is set so that the largest diameter coins to be wrapped can pass therethrough. Above the coin passage 5, there is provided a transporting belt 8 wound about pulleys 7 so that the coins can be held between the transporting belt and the upper face of the coin passage 5 and transported. The rotatable disc 2 and the pulleys 7 are rotatable in both forward and reverse directions. The annular guide 4 has a projection 4*a* which projects onto the rotatable disc 2 at a position immediately upstream of the opening 3 with respect to the rotating direction of the rotatable disc 2 when it rotates so as to feed the coins 1 into the coin passage 5. Accordingly, the coins 1 to be fed from the rotatable disc 2 into the coin passage 5 are fed toward the guide member 6*b* of the coin passage 5 by the projection 4*a* and are transported along the guide member 6*b* in the coin passage 5 by the transporting belt 8.

The coin passage 5 is provided with a bottom plate 9 formed with a light receiving opening 10 and a glass plate 11 is fitted into the bottom plate 9 for covering the light receiving opening 10, the upper face cf the glass plate 11 and the upper face of the rotatable disc 2 being positioned in the same plane.

Downstream of the coin passage 5, a guide block 12 is provided, the position thereof being adjustable in the direction perpendicular to the coin transporting direction the space between itself and the guide member 6*b* being set so as to be greater than the diameter of the coins to be wrapped and smaller than that of smallest coins among coins having diameters greater than that of the coins to be wrapped. The guide block 12 is provided with a slope portion 12*a*, the height thereof being gradually increased downstream with respect to the coin transporting direction, a horizontal portion 12*b* continuously connected to the slope portion downstream thereof and a side face 12*d* having a bent portion 12*c* downstream of the slope portion 12*a*. A swing arm 14 is mounted on the guide block 12 at one end portion thereof so as to swingable about a shaft 13 and a rotatable roller 15 is mounted on the other end portion of the swing arm 14. A tension spring 16 secured to the guide block 12 at one end thereof is secured to the arm 14 at the other end thereof and the arm 14 is biased counterclockwise in FIG. 1. The position of the arm 14 is set by a stopper pin 17 so that the roller 15 is positioned above the slope portion 12*a* and the periphery of the roller 15 and the side face of the slope portion 12*a* on the side of the coin passage 5 are positioned in the same plane.

The direction of the coin passage 5 is turned by about 90 degree along the bent portion 12*c* and the coin passage 5 downstream of the bent portion 12*c* is formed with a small coin collecting opening 18 for collecting coins of smaller diameters than that of the coins to be wrapped, the diameter of the small coin collecting opening 18 being adjustable. Further, downstream of the guide block 12 in the direction in which the coin passage 5 is extended from the rotatable disc 2, a large diameter coin collecting opening 19 is provided for collecting coins of larger diameters than that of the coins to be wrapped and the diameter thereof is set so as to able to collect the largest coins among those to be deposited into the coin wrapping machine. Therefore, after the diameter of the small coin collecting opening is adjusted so as to be smaller than the diameter of the coins to be wrapped and larger than the largest coins among those of smaller diameters than that of the coins to be wrapped and the space between the guide member 6*b* and the side face 12*d* of the guide block 12 is adjusted so as to be greater than the diameter of the coins to be wrapped and smaller than the smallest coins among those of larger diameters than that of the coins to be wrapped, when the coins 1 are fed from the rotatable disc 2 into the coin passage 5, the coins 1 to be wrapped and the coins 1 of smaller diameters than that of the coins to be wrapped (hereinafter referred to as "small coins") among those transported from the rotatable disc 2 into the coin passage 5 are guided by the side face 12*d* and the bent portion 12*c* of the guide block 12 and the direction of transportation is turned by about 90 degree at the bent portion 12*c* and are further transported downstream in the coin passage 5. Then, the small coins 1 drop into the small coin collecting opening 18 thereby to be collected and only the coins 1 to be wrapped are further transported downstream in the coin passage 5 and after a predetermined number of the coins 1 are stacked by a stacking apparatus (not shown), each predetermined number of coins are wrapped by a wrapping apparatus (not shown). On the hand, since the space between the guide member 6*b* and the side face 12*d* of the guide block 12 is set so as to be greater than the diameter of the coins 1 to be wrapped and smaller than the smallest coins 1 among coins 1 of larger diameters than that of the coins 1 to be wrapped, the coins 1 of larger diameters than that of the coins 1 to be wrapped (hereinafter referred to as "large coins") are transported so that one edge thereof is guided by the inner face of the guide member 6b and the opposite edge thereof climbs up on the slope portion 12a of the guide block 12 and are further transported on the horizontal portion 12b while being inclined, whereby they drop into the large coin collecting opening 19 without being guided by the bent portion 12c and are collected.

A plurality of light emitting elements 21 are mounted on a stay 20 provided above the coin passage 5 upstream of the guide block 12 so as to be arranged in the direction perpendicular to the coin transporting direction. A sensor array 23 consisting of a plurality of light receiving elements is mounted via terminals 23a on a board 22 disposed below the glass plate 11 fitted into the bottom plate 9 so as to be disposed in the direction perpendicular to the coin transporting direction and at a position opposite to the light emitting elements 21, that is, at a position where it can receive light emitted from the light emitting elements 1 toward the coin passage 5. Further, stays 24, 25 are respectively secured to the upper faces of the guide members 6a, 6b and first coils 26, 26 to which a high frequency alternating current is applied are secured to the stays 24, 25, whereby an magnetic field is produced therebelow. Moreover, second coils 27, 27 are mounted on the lower face of the board 22 at positions opposite to the first coils 26, 26 and slightly upstream thereof and a magnetic sensor 28 is formed by the first coils 26, 26 and the second coils 27, 27. As shown in FIGS. 2 and 3, the first coils 26, 26 and the second coils 27, 27 are disposed slightly downstream of the sensor array 23 so that the sensor array 23 is positioned therebetween in the vertical direction. Accordingly, the coins 1 fed out from the rotatable disc 2 into the coin passage 5 are transported by the transporting belt 8 within the coin passage 5 and when a coin 1 passes through above the sensor array 23, a part of light emitted from the light emitting elements 21 is intercepted by the coin 1, whereby some of the picture elements of the sensor array cannot receive light. Therefore, it is possible to detect the diameter of the coin 1 based upon the number of picture elements of the sensor array 23, that is, the optical data detected by the sensor array 23. Further, when a coin 1 passes through between the first coils 26, 26 and the second coils 27, 27, the magnetic field produced by the first coils 26, 26 is changed and an electrical current flowing through the second coils 27, 27 is changed in accordance with change in the magnetic field, the degree of change in the electrical current depending upon the material of coin 1. Thus, it is possible to discriminate the material of the coin 1 based upon the value of change in the electrical current flowing through the second coils 27, 27.

In the coin wrapping machine including the thus constituted coin discriminating and counting apparatus, the space between the side face 12d of the guide block 12 and the guide member 6b is first set smaller than the diameter of the smallest coins. Then, coins 1 are deposited through the coin depositing section (not shown) and discrimination is made by the sensor array 23 and the magnetic sensor 28 as to the denominations, currency and the like of the coins. As a result, if a coin not in circulation such as a counterfeit coin or a foreign coin is discriminated, after the transporting belt 8 and the rotatable disc 2 are stopped and the coin wrapping machine is opened, the coin 1 is removed from the coin wrapping machine and collected. On the other hand, in the case where a current coin is discriminated, the denomination thereof is discriminated and the number of coins 1 of the respective denominations is counted. As described above, since the space between the side face 12d of the guide block 12 and the guide member 6b is set so as to be smaller than the diameter of the smallest coin, all coins 1 which have passed through the sensor array 23 and the magnetic sensor 28 climb up the slope portion 12a of the guide block 12 and are collected through the large coin collecting opening 19. Afterward, the space between the side face 12d of the guide block 12 and the guide member 6b is set so as to be greater than the diameter of the denomination of the coins 1 whose counted number is greatest and smaller than the diameter of the smallest coin 1 among the coins 1 of larger diameters than the first mentioned denomination of coins 1 and the coins 1 of the first mentioned denomination are wrapped. Then, the space between the side face 12d of the guide block 12 and the guide member 6b is set so as to be greater than the diameter of the denomination of coins 1 whose counted number is second greatest and smaller than the diameter of the smallest coin 1 among the coins 1 of larger diameters than coins 1 of the first mentioned denomination and the coins 1 whose counted number is second greatest are wrapped. In this manner, the coins 1 are wrapped in order from those of the denomination represented in the largest number to those of the denomination represented in the smallest number. The coin wrapping operation is carried out for each predetermined number of coins and any remaining number of coins 1 smaller than the predetermined number are returned onto the rotatable disc 2 by reversely rotating the pulleys 7 and the rotatable disc 2 and are collected. Further, in cases where the sensor array 23 does not detect any coin 1 for a predetermined time period since this means that coin jamming has occurred or that coins are not being smoothly fed in the coin passage 5, the coins 1 are returned onto the rotatable disc 2 by reversely rotating the pulleys 7 and the rotatable disc 2 and then the coins 1 are fed from the rotatable disc 2 to the coin passage 5 again.

Figure 4:
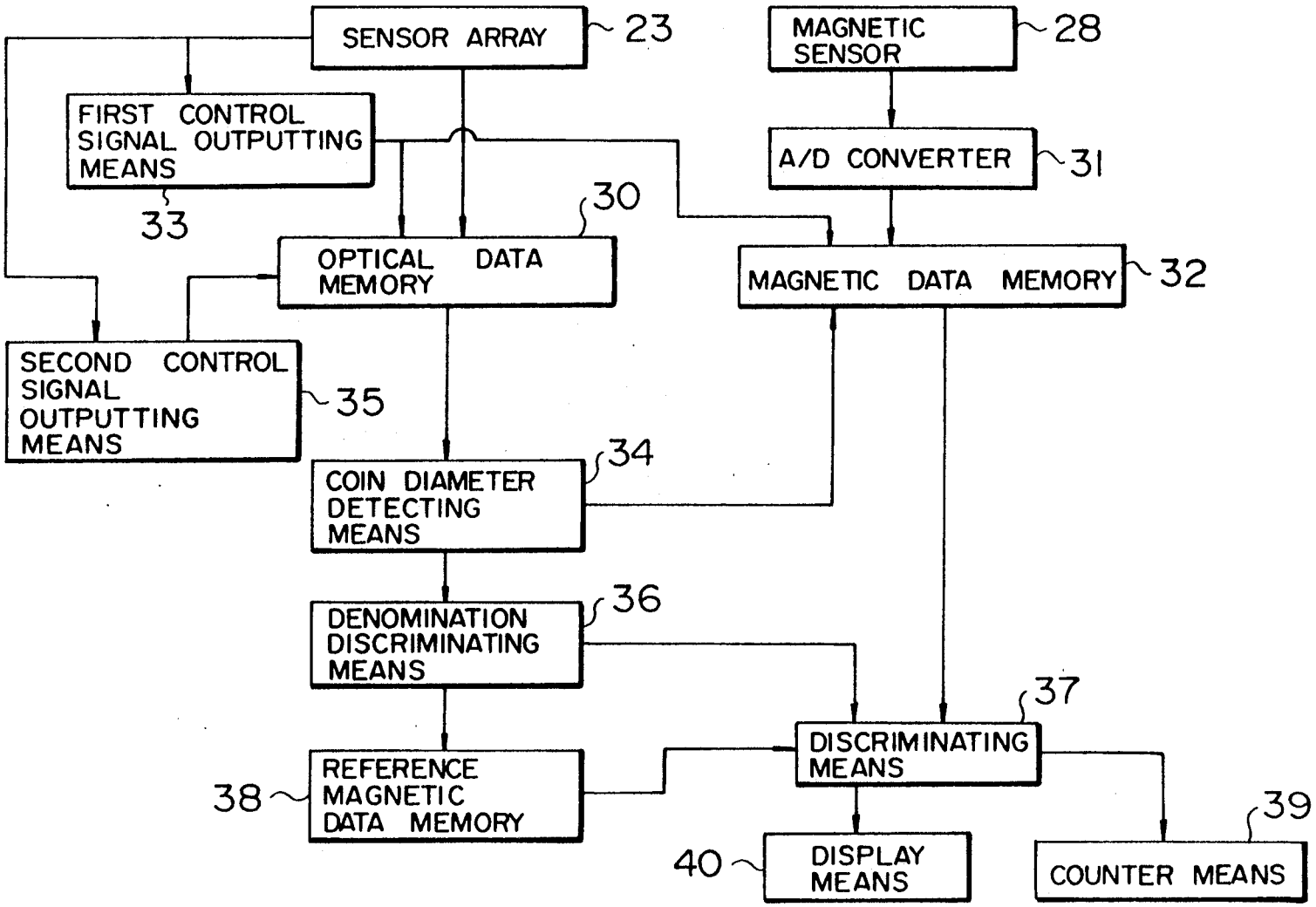
FIG. 4 is a block diagram of detection, control and output systems of a coin discriminating and counting apparatus which is an embodiment of the present invention.

FIG. 4 is a block diagram showing detection, control and output systems of the coin discriminating and counting apparatus which is an embodiment of the present invention.

In FIG. 4, the detection, control and output systems of this embodiment comprises an optical data memory 30 capable of storing optical data detected by the sensor array 23, an A/D converter 31 for A/D converting output signals from the magnetic sensor 28, a magnetic data memory 32 capable of storing magnetic data detected by the magnetic sensor 28 and A/D converted by the A/D converter 31, a first control signal outputting means 33 for outputting a first timing signal to the optical data memory 30 and the magnetic data memory 32 when the sensor array 23 detects optical data equal to a first predetermined value thereby to enable the optical data memory 30 and the magnetic data memory 32 to respectively store the optical data input from the sensor array 23 and the magnetic data input from the magnetic sensor 28 via the A/D converter 31 and outputting a second timing signal to the optical data memory 30 and the magnetic data memory 32 when the sensor array 23 again detects optical data equal to the first predetermined value after it detected the optical data equal to the first predetermined value thereby to enable the optical data memory 30 and the magnetic data memory 32 to respectively stop storing the optical data input from the sensor array 23 and the magnetic data input from the magnetic sensor 28 via the A/D converter 31, a second control signal outputting means 35 for outputting a third timing signal to the optical data memory 30 when the sensor array 23 detects a second predetermined value less than the first predetermined value after it detected the optical data equal to the first predetermined value thereby to enable the optical data memory 30 to output the optical data stored therein to a coin diameter detecting means 34 and to enable the same to start an operation for detecting the diameter of coin 1, the coin diameter detecting means 34 for detecting the diameter of coin 1 based upon the maximum value of the optical data input from the optical data memory 30 and outputting a coin diameter detection signal to the magnetic data memory 32 and a denomination discriminating means 36 thereby to enable the magnetic data memory 32 to output magnetic data stored when the maximum value of the optical data was stored in the optical data memory 30 to a discriminating means 37 and the denomination discriminating means 36 to discriminate the coin denomination, the denomination discriminating means 36 for storing diameters for respective denominations of coins in advance and discriminating the denomination of coin based upon the coin diameter detected by the coin diameter detecting means 34 thereby to output a denomination discriminating signal to the discriminating means 37 and a reference magnetic data memory 38, the reference magnetic data memory 38 for storing reference magnetic data for respective denominations of coins which are detected when a center portion of coins passes through the sensor array 23 and outputting reference magnetic data corresponding to the denomination discriminated by the denomination discriminating means 36 to the discriminating means 37 when it receives the denomination discriminating signal from the denomination discriminating means 36, a discriminating means 37 for comparing the magnetic data input from the magnetic data memory 32 with the reference magnetic data input from the reference magnetic data memory 38 and outputting a denomination signal to a counter means 39 in accordance with the denomination discriminating signal input from the denomination discriminating means 36 when the difference between the magnetic data and the reference magnetic data is not more than a predetermined value, while outputting an abnormal signal to a display means 40 when the difference between the magnetic data and the reference magnetic data is not more than a predetermined value, the counter means 39 for counting and storing the number of coins for each denomination, and the display means 40 for displaying information that a coin not in circulation such as a counterfeit coin, a foreign coin or the like is detected when the abnormal signal is input from the discriminating means 37.

In the thus constituted detection system, control system and output system of the coin discriminating and counting apparatus, coins 1 are fed out from the rotatable disc 2 into the coin passage 5 and are transported by the transporting belt 8 within the coin passage 5. Then, when a coin 1 has reached the sensor array 23, a part of the light emitted from the light emitting elements 21 is intercepted by the coin 1 and, as a result, some of the picture elements of the sensor array 23 do not receive light emitted from the light emitting elements 21. Further, when the coin 1 passes through between the first coils 26, 26 and the second coils 27, 27, the magnetic field produced by the first coils 26, 26 is changed and an electrical current flowing through the second coils 27, 27 is changed. The number of the picture elements of the sensor array 23 is fed as the optical data detected by the sensor array 23 to the optical data memory 30, the first control signal outputtinq means 33 and the second control signal outputting means 35. On the other hand, a value represented the change in the electrical current flowing through the second coils 27, 27 is input to the magnetic data memory 32 as the magnetic data detected by the magnetic sensor 28 consisting of the first coils 26, 26 and the second coils 27, 27 after they were A/D converted by the A/D converter 31. As the coin 1 is transported downstream, the number of the picture elements of the sensor array 23 which do not receive light emitted from the light emitting elements 21, that is, the optical data are gradually increased and the first control signal outputting means 33 detects that the optical data equals to the fist predetermined number, it outputs the first timing signal to the optical data memory 30 and the magnetic data memory 32. The optical data memory 30 starts storing the optical data input from the sensor array 23 at the time the first timing signal is input and the magnetic data memory 32 starts storing the magnetic data input from the magnetic sensor 28 via the A/D converter 31 at the time the first timing signal is input.

Afterward, when the number of the picture elements, that is the optical data, becomes equal to the first predetermined value again, the first control signal outputting means 33 outputs the second timing signal to the optical data memory 30 and the magnetic data memory 32. When the second timing signal is input, the optical data memory 30 stops storing the optical data input from the sensor array 23 and the magnetic data memory 32 stops storing the magnetic data input from the magnetic sensor 28 via the A/D converter 31.

Then, when the number of the picture elements, that is the optical data, becomes equal to the second predetermined value less than the first predetermined value, the second control signal outputting means 35 outputs the third timing signal to the optical data memory 30, thereby to enable the same to output the optical data stored therein to the coin diameter detecting means 34.

When the coin diameter detecting means 34 receives the optical data from the optical data memory 30, it finds the maximum value of the number of the picture elements of the sensor array which do not receive light emitted from the light emitting elements 21, that is, the maximum value of the optical data among the thus input optical data. Since the maximum value represents the diameter of the coin 1, the coin diameter detecting means 34 outputs the coin diameter detection signal to the magnetic data memory 32 and the denomination discriminating means 36.

When the coin diameter detection signal is input from the coin diameter detecting means 36, the magnetic data memory 32 finds the magnetic data input from the magnetic sensor 28 when the maximum value of the number of the picture elements of the sensor array not receiving light emitted from the light emitting elements 21, that is the maximum value of the optical data, was input from the sensor array 23 and outputs the magnetic data to the discriminating means 37. The thus output magnetic data was detected when the coin 1 passed through the magnetic sensor 28.

On the other hand, the denomination discriminating means 36 compares reference coin diameter data stored in advance for the respective denominations of the coins with the detected value of the coin diameter input from the coin diameter detecting means 34 thereby to discriminate the denomination of the coin 1 and output the denomination discriminating signal to the reference magnetic data memory 38 and the discriminating means 37.

In the reference magnetic data memory 38, the reference magnetic data for the respective denominations of the coins detected when the center portion of coin 1 passes through the magnetic sensor 28 are stored in advance and the reference magnetic data memory 38 selects the reference magnetic data corresponding to the denomination discriminated by the denomination discriminating means 36 based upon the denomination discriminating signal input from the denomination discriminating means 36 from among the reference magnetic data stored therein.

The discriminating means 37 compares the magnetic data input from the magnetic data memory 32 with the reference magnetic data input from the reference magnetic data memory 32 and when it judges that the difference therebetween is not more than a predetermined value, since it is considered that the denomination discriminated based upon the optical data by the denomination discriminating means 36 and the denomination discriminated based upon the magnetic data agree with each other, the discriminating means 37 outputs the denomination signal of the denomination corresponding to that discriminated by the denomination discriminating means 36 to the counter means 39 in accordance with the denomination discriminating signal input from the denomination discriminating means 36. On the contrary, when the discriminating means 37 judges that the difference between the magnetic data input from the magnetic data memory 32 and the reference magnetic data input from the reference magnetic data memory 38 is more than the predetermined value, since the denomination discriminated based upon the optical data by the denomination discriminating means 36 and the denomination discriminated based upon the magnetic data do not agree with each other and there is some probability that a coin not in circulation such as a counterfeit coin, a foreign coin or the like has been fed, the discriminating means 37 outputs the abnormal signal to the display means 40 thereby to enable the same to display information that a coin not in circulation such as a counterfeit coin, a foreign coin or the like was detected.

According to this embodiment, since the magnetic sensor 28 is disposed so that the sensor array 23 is positioned therebetween, it is possible to make the coin discriminating and counting apparatus small in size and since it is ensured that the magnetic data detected when the center portion of a coin 1 passes through the magnetic sensor 28 are compared with the reference magnetic data for discriminating the denominations, currency and the like of the coins 1, it is possible to discriminate the denominations and currency of coins 1 with high accuracy.

Figure 5:
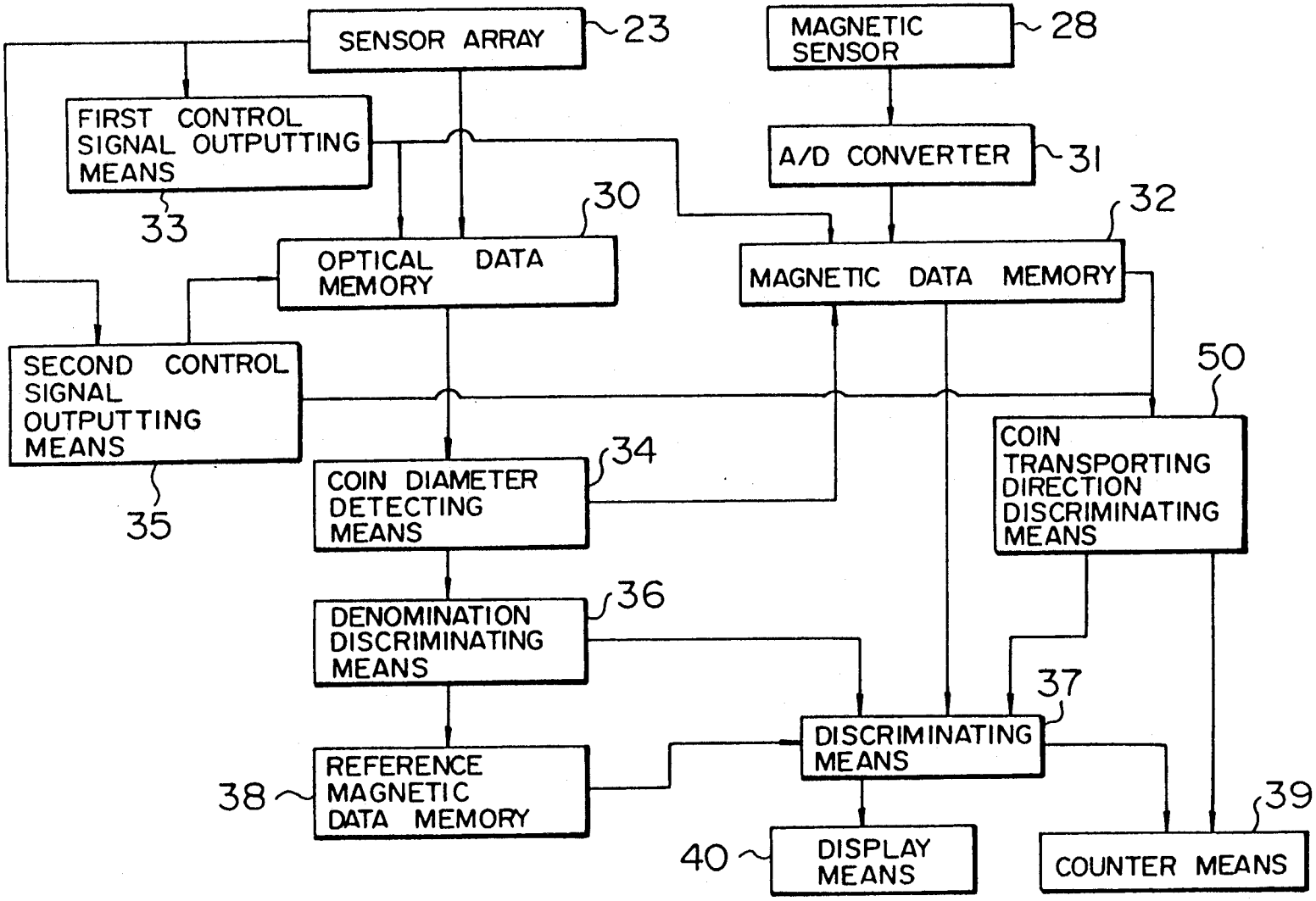
FIG. 5 is a block diagram of detection, control and output systems of a coin discriminating and counting apparatus which is another embodiment of the present invention.

FIG. 5 is a block diagram showing detection, control and output systems of a coin discriminating and counting apparatus which is another embodiment of the present invention.

The detection, control and output systems of the coin discriminating and counting apparatus of this embodiment further include a coin transporting direction discriminating means 50 for discriminating the coin transporting direction based upon the magnetic data and is constituted so that the second control signal outputting means 35 further outputs the third timing signal to the coin transporting direction discriminating means 50 and that the magnetic data memory 32 outputs the magnetic data M1 input from the magnetic sensor 28 via the A/D converter 31 when it receives the first timing signal from the first control signal outputting means 33 to the coin transporting direction discriminating means 50 and outputs the magnetic data M2 input from the magnetic sensor 28 via the A/D converter 31 when it receives the second timing signal from the first control signal outputting means 33 to the coin transporting direction discriminating means 50. Further, the coin transporting direction discriminating means 50 is constituted so that it stores the magnetic data M1 and M2 input from the magnetic data memory 32 and calculates the difference (M1–M2) between the magnetic data M1 and M2 when the third timing signal is input from the second control signal outputtinq means 35 thereby to output an addition signal to the counter means 39 when the difference is positive and output a subtraction signal to the counter means 39 when the difference is negative, while it outputs a discrimination stop signal to the discriminating means 37. Other arrangement is the same as that of the detection, control and output systems of the coin discriminating and counting apparatus shown in FIG. 4.

More specifically, since the magnetic sensor 28 comprising of the first coils 26, 26 and the second coils 27, 27 is disposed slightly downstream of the sensor array 23, the optical data detected by the sensor array 23 and the magnetic data detected by the magnetic sensor 28 when the coin 1 passes through the sensor array 23 and the magnetic sensor 28 are respectively obtained as the wave forms shown in FIG. 5 wherein the peak of the magnetic data is slightly offset downstream of that of the optical data. These wave forms are the same for the same coin 1 in the case where a coin 1 is transported from upstream to downstream or the case where the coin 1 is transported from downstream to upstream.

Figure 6:
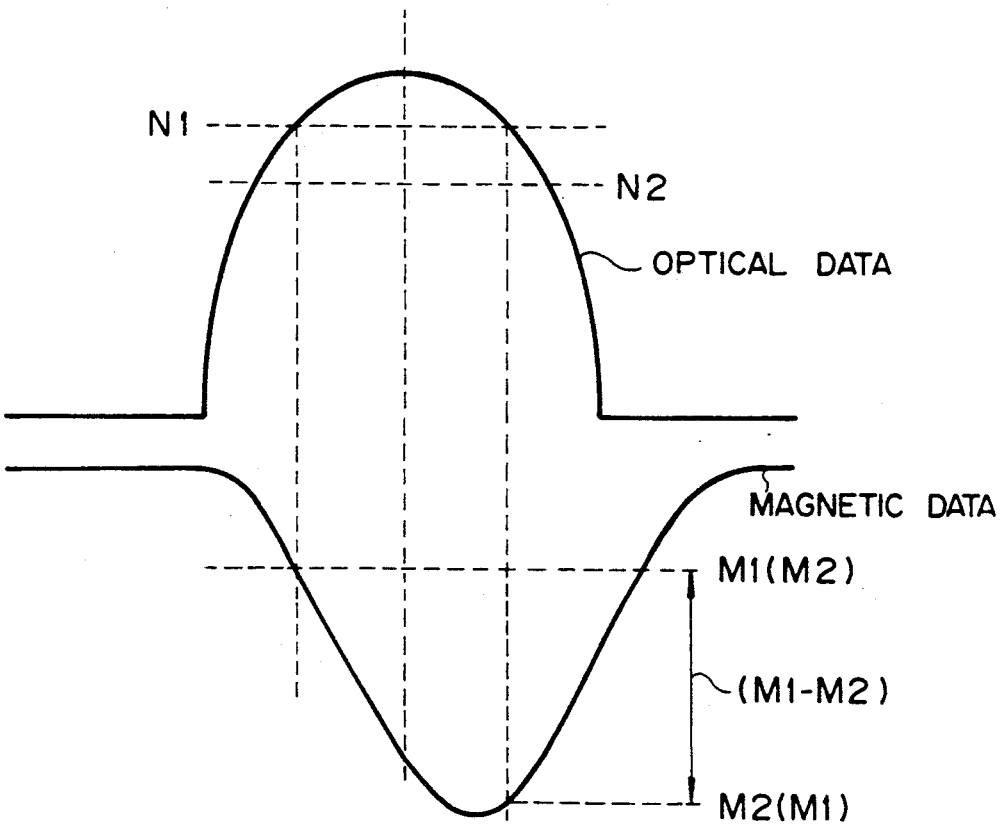
FIG. 6 is a graph showing wave forms of optical data and magnetic data detected by a coin discriminating and counting apparatus which is an embodiment shown in FIG. 5.

The magnetic data memory 32 outputs the magnetic data M1 input from the magnetic sensor 28 when the sensor array 23 detects the optical data equal to the first predetermined value N1 and the first timing signal is input from the first control signal outputting means 33 and the magnetic data M2 input from the magnetic sensor 28 when the sensor array 23 detects the optical data equal to the first predetermined value N1 again after it detected the optical data equal to the first predetermined value N1 once and the second timing signal is input from the first control signal outputting means 33 to the coin transporting direction discriminating means 50 respectively where these magnetic data M1 and M2 are stored. As described above, since the wave forms of the optical data and the magnetic data obtained from the same coin 1 are the same irrespective of the coin transporting direction, as apparent from FIG. 6, the magnetic data M1 and M2 stored in the coin transporting direction discriminating means 50 when the coin 1 is transported from upstream to downstream respectively correspond to the magnetic data M2 and M1 stored in the coin transporting direction discriminating means 50 when the coin 1 is transported from downstream to upstream. Thus, the magnetic data M1 and M2 stored when the coin 1 is transported from downstream to upstream are given in parentheses in FIG. 6. Further, since the sensor array 23 is disposed slightly upstream of the magnetic sensor 28, as shown in FIG. 6, the magnetic data M1 is greater than the magnetic data M2 when the coin 1 is transported from upstream to downstream and, on the other hand, smaller than the magnetic data M2 when the coin 1 is transported from downstream to the upstream.

Therefore, in the case where the difference (M1-M2) between the magnetic data M1 and M2 is positive, which is calculated by coin transporting direction discriminating means 50 when the sensor array 23 detects the optical data equal to a second predetermined value N2 after it detected the optical data equal to the first predetermined value N1 and the second control signal outputting means 35 outputs the third timing signal, since it can be considered that the coins are deposited into the coin wrapping machine, the coin transporting direction discriminating means 50 outputs the addition signal to the counter means 39 and the number of the coins having the denomination discriminated by the denomination discriminating means 36 is increased by one. On the contrary, when the difference (M1-M2) is negative, it can be judged that the coin 1 is transported from downstream to upstream in cases where some of the coins 1 are returned onto the rotatable disc 2 after the wrapping operation of coins 1 has been completed or where since the coins are not smoothly fed within the coin passage 5 due to coin jamming or the like, the coins 1 are returned onto the rotatable disc 2 to restart feeding coins 1 into the coin passage 5. In this case, since the coin 1 which passed through the sensor array 23 and the magnetic sensor 28 had passed through the sensor array 23 and the magnetic sensor 28 once from upstream to downstream and had already been counted by the counter means 39, the coin transporting direction discriminating means 50 outputs the subtraction signal to the counter means 39 thereby to reduce the number of coins having the denomination discriminated by the denomination discriminating means 36 by one. Further, although the coin 1 is transported from upstream to downstream and after the sensor array 23 detected the optical data equal to the first predetermined value N1 and the first timing signal was output from the first control signal outputting means 33, there may be a case where the transportation of the coin 1 is stopped before the sensor array 23 again detects the optical data equal to the first predetermined value and the coin 1 is returned onto the rotatable disc 2. In this case, when the coin 1 is transported from downstream to upstream, the sensor array 23 again detects the optical data equal to the first predetermined value N1 and the second timing signal is output from the first control signal outputting means 33. Then, the sensor array 23 detects the optical data equal to the second predetermined value N2. In this case, the difference (M1-M2) between the magnetic data M1 and M2 equals zero and the coin has not been discriminated and counted. Therefore, since it is neither necessary to carry out any adding operation nor subtracting operation in the counter means 39, the coin transporting direction discriminating means 50 does not output any signal to the counter means 30 but outputs the discrimination stop signal to the discriminating means 37 thereby to stop the discriminating operation in the counter means 39.

According to this embodiment, it is possible discriminate without fail, by comparing the magnetic data M1 input from the magnetic data memory 32 when the first timing signal is input from the first control signal outputting means 33 with the magnetic data M2 input from the magnetic data memory 32 when the second timing signal is input, between the case where the coins 1 are deposited into the coin wrapping machine for sorting and counting coins 1 in accordance with their denominations or for wrapping coins 1, are transported from upstream to downstream within the coin passage 5 and it is necessary to discriminate coins and carry out the adding operation of the number of coins, or carry out the adding operation of the number of coins by the coin discriminating and counting apparatus, the case where since some of the coins 1 are returned onto the rotatable disc 2 after the wrapping operation of coins 1 has been completed, or when the coins 1 are returned onto the rotatable disc 2 to restart feeding coins 1 into the coin passage 5 because the coins are not being smoothly fed within the coin passage 5 due to coin jamming or the like, coins which have been already discriminated and the number of which has been already counted is transported from downstream to upstream and it is necessary to carry out the subtracting operation of the number of coins 1, and the case where although a coin 1 is transported from downstream to upstream, since the counting of the coin 1 has not been carried out yet, neither any adding operation nor subtracting operation is not necessary.

Figure 7:
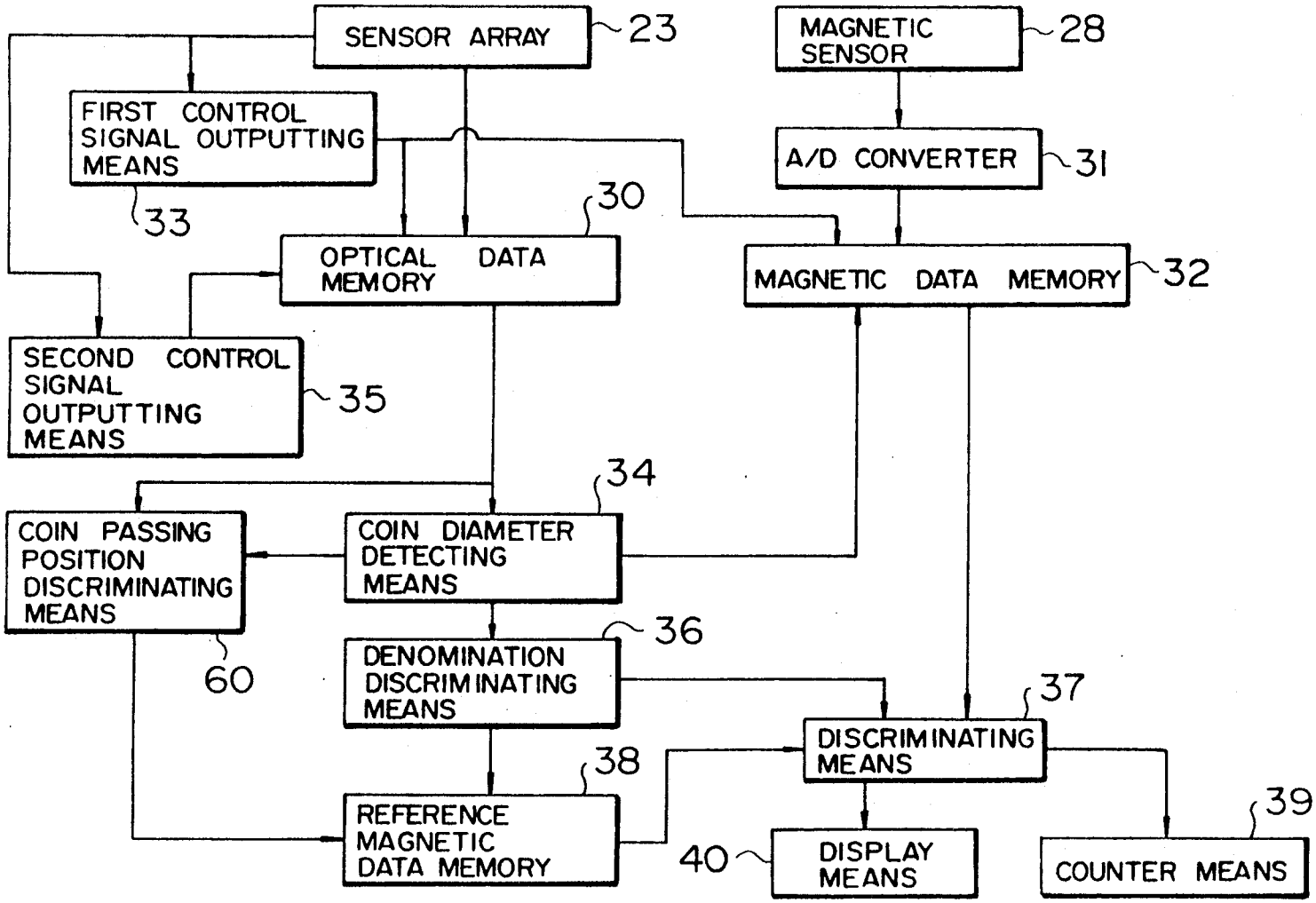
FIG. 7 is a block diagram of detection, control and output systems of a coin discriminating and counting apparatus which is a further embodiment of the present invention.

FIG. 7 is a block diagram showing detection, control and output systems of the coin discriminating and counting apparatus which is a further embodiment of the present invention.

The detection, control and output systems shown in FIG. 7 further includes a coin passing position discriminating means 60 and is constituted so that when the third timing signal is input from the second control signal outputting means 35 to the optical data memory 30, the optical data stored in the optical data memory 30 are output to the coin passing position discriminating means 60 and that when the coin diameter detecting means 34 detects the diameter of coin 1, the coin diameter detection signal is output to the coin passing position discriminating means 60 which detects based upon the optical data input from the optical data memory 30 at what position the coin 1 passes in the coin passage 5 with respect to the widthwise direction thereof when the center portion of coin 1 passes through the magnetic sensor 28 and outputs a coin passing position discriminating signal to the reference magnetic data memory 38 which stores in advance the reference magnetic data for respective denominations in accordance with positions at which the coins 1 pass, selects the reference magnetic data from among the reference magnetic data stored therein based upon the denomination discriminating signal input from the denomination discriminating means 36 and the coin passing position discriminating signal input from the coin passing position discriminating means 60 and outputs them to the discriminating means 37 thereby to cause the same to discriminate whether or not the thus input reference magnetic data and the magnetic data input from the magnetic data memory 32 agree with each other and output the denomination signal to the counter means 39 in accordance with the denomination discriminating signal input from the denomination discriminating means 39 when they agree with each other and the abnormal signal to the display means 40 when they do not agree. In other respects, the arrangement is the same as that of the detection, control and output systems of the coin discriminating and counting apparatus shown in FIG. 4.

In the coin discriminating and counting apparatus shown in FIG. 7, the reference magnetic data memory 38 stores different reference magnetic data even for the same denomination of coin 1 depending upon positions with respect to the widthwise direction of the coin passage 5 at which the coins 1 passes through the magnetic sensor 28 and the coin passing position discriminating means 60 detects, based upon the optical data input from the optical data memory 30 and the coin diameter detection signal input from the coin diameter detecting means 36, the position with respect to the widthwise direction of the coin passage 5 at which the center portion of the coin 1 passes through the magnetic sensor 28, whereby the reference magnetic data to be compared with the magnetic data output from the magnetic data memory 32 are selected based upon the thus detected coin passing position in the reference magnetic data memory 38 and discrimination is made based upon the magnetic data.

More specifically, since the magnetic data detected when the center portion of coin 1 passes through the magnetic sensor 28 are different depending upon the position with respect to the widthwise direction of the coin passage 5 at which the coin 1 passes through the magnetic sensor 28, as described above, the coins 1 are fed toward the guide member 6*b* into the coin passage 5 by the projection 4*a* of the annular guide 4 so that they are transported along the guide member 6*b* by the transporting belt 8 within the coin passage 5. However, even in this case, the edge of a coin 1 which should contact the guide member 6*b* may be apart from the guide member 6*b* when the coin 1 passes through the magnetic sensor 28. Therefore, the reference magnetic data for respective denominations detected depending upon the positions with respect to the widthwise direction of the coin passage 5 at which the coins 1 pass are stored in the reference magnetic data memory 38 and the position of coin 1 is detected by the coin passing position discriminating means 60 based upon the magnetic data detected by the sensor array 23 and stored in the optical data memory 30 when the coin 1 passes through the magnetic memory 32, whereby the reference magnetic data to be compared with the magnetic data detected when the center portion of coin 1 passes through the magnetic sensor 28 are selected and discrimination based upon the magnetic data is made.

According to this embodiment, since the position at which the coin 1 passes through the magnetic sensor 28 is detected thereby to select the reference magnetic data among from the reference magnetic data for respective denominations experimentally obtained depending upon the positions at which coins 1 pass through the magnetic sensor 28 and discrimination of coins 1 is made, even in the case where coins 1 are not transported in the desired manner, it is possible to discriminate the denominations, currency and the like of the coins 1 with high accuracy.

Figure 8:
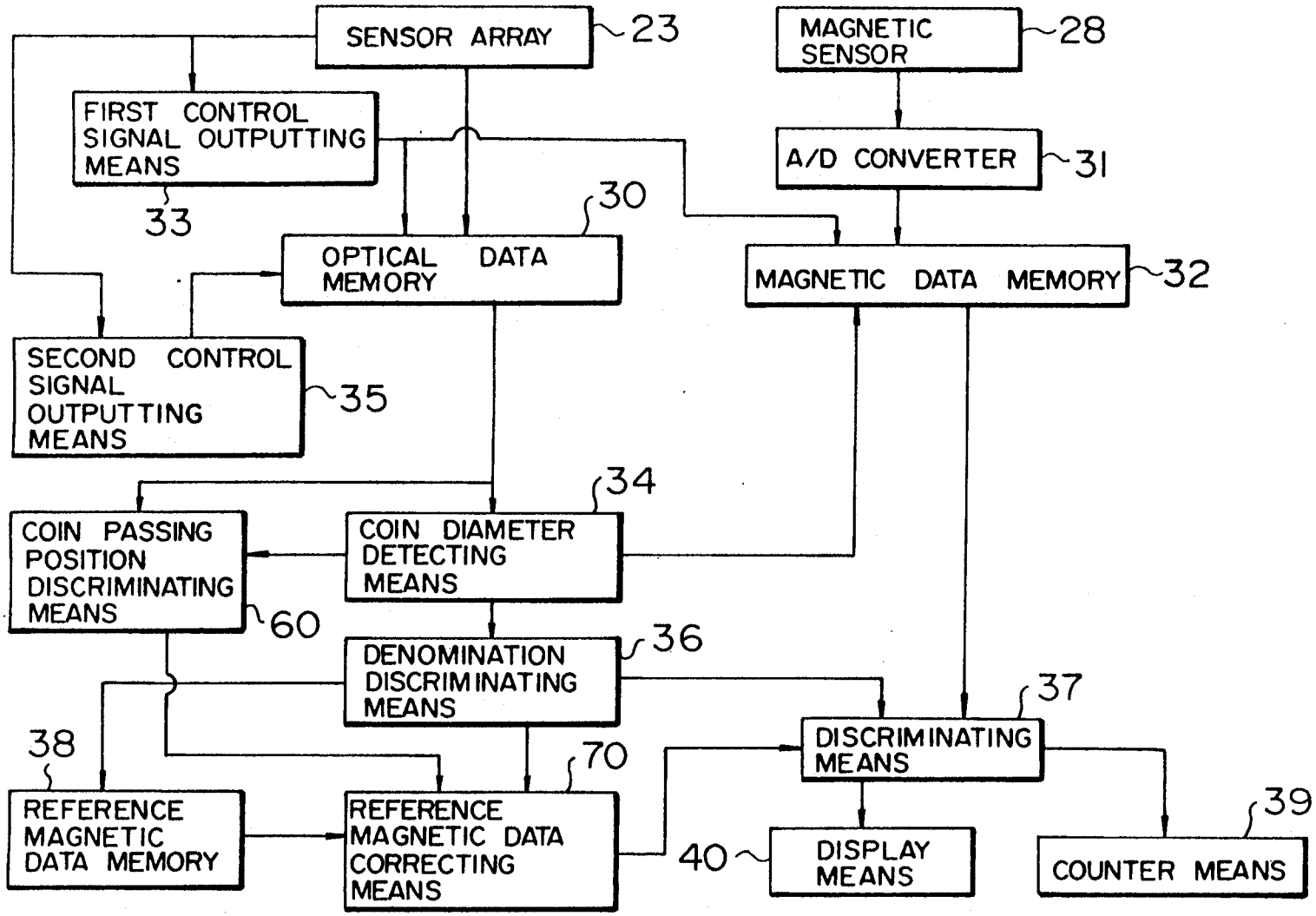
FIG. 8 is a block diagram of detection, control and output systems of a coin discriminating and counting apparatus which is a further embodiment of the present invention.

FIG. 8 is a block diagram showing detection, control and output systems of a coin discriminating and counting apparatus which is a further embodiment of the present invention.

Although the detection, control and output systems of the coin discriminating and counting apparatus shown in FIG. 8 are further provided with the coin passing position discriminating means 60 similarly to the detection, control and output systems shown in FIG. 7, only the reference magnetic data detected when the coins 1 pass through the magnetic sensor 28 along the guide member 6*b* are stored in the reference magnetic data memory 38 similarly to the embodiments shown in FIGS. 4 and 5 and, instead, a reference magnetic data correcting means 70 is provided for correcting the reference magnetic data in accordance with the position of coin 1 with respect to the widthwise direction of the coin passage 5 detected by the coin passing position discriminating means 60 and outputting them to the discriminating means 37.

More specifically, similarly to the embodiments shown in FIGS. 4 and 5, although the reference magnetic data obtained in the case where the coins 1 pass through the magnetic sensor 28 along the guide member 6*b* are stored in the reference magnetic data memory 38 and the reference magnetic data memory 38 outputs the reference magnetic data of the denomination discriminated by the denomination discriminating means 36 based upon the denomination discriminating signal input from the denomination discriminating means 36, the reference magnetic data are input to the reference magnetic data correcting means 70. The reference magnetic data correcting means 70 stores correction coefficients X experimentally determined in advance in accordance with the positions at which the coins 1 pass and selects a desired correction coefficient X based upon the coin passing position discriminating signal input from the coin passing position discriminating means 60 thereby to correct the reference magnetic data input from the reference magnetic data memory 38 and then output the thus corrected reference magnetic data to the discriminating means 37.

Accordingly, in this embodiment, similarly to the embodiment shown in FIG. 7, it is possible to discriminate the denominations, currency and the like of the coins 1 with high accuracy even in the case where the coins 1 are not transported in the desired manner.

Figure 9:
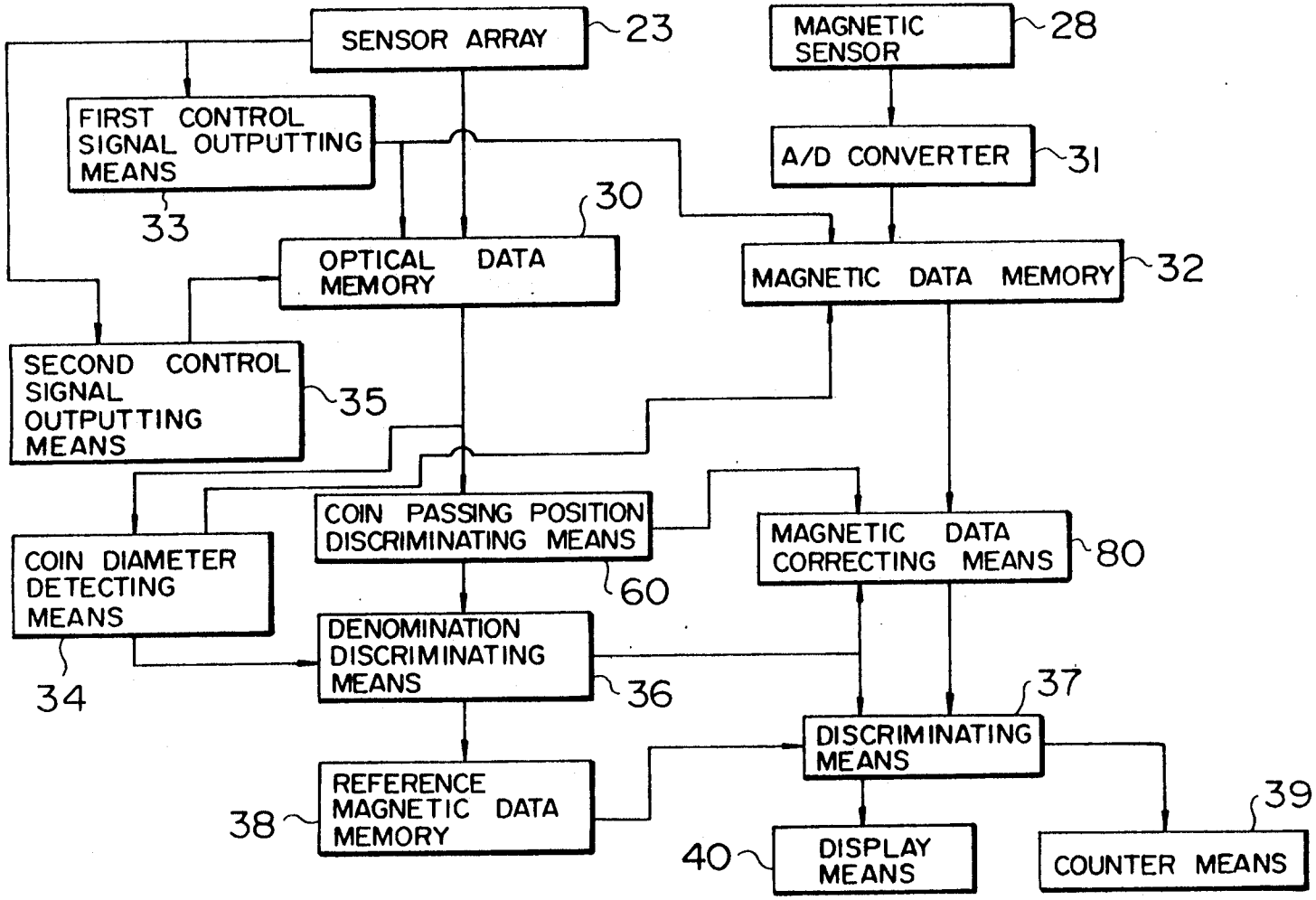
FIG. 9 is a block diagram of detection, control and output systems of a coin discriminating and counting apparatus which is a further embodiment of the present invention.

FIG. 9 is a block diagram showing detection, control and output systems of a coin discriminating and counting apparatus which is a further embodiment of the present invention.

Although the detection, control and output systems of the coin discriminating and counting apparatus shown in FIG. 9 are provided with the coin passing position discriminating means 60 similarly to the detection, control and output systems shown in FIGS. 7 and 8, the reference magnetic data memory 38 stores only the reference magnetic data obtained when the coins 1 pass through the magnetic sensor 28 along the guide member 6*b* and, instead, a magnetic data correcting means 80 is provided for correcting the magnetic data output from the magnetic data memory 32 in accordance with the position at which the coin 1 passes the magnetic sensor 28 and which is detected by the coin passing position discriminating means 60. In this embodiment, discrimination of coins 1 is made based upon the magnetic data in such a manner that the magnetic data detected when the center portion of the coin 1 passes through the magnetic sensor 28 are corrected by the magnetic data correcting means 80 in accordance with the coin passing position discriminating signal input from the coin passing position discriminating means 60 and are output to the discriminating means 37 where they are compared with the reference magnetic data output from the reference magnetic data memory 38.

More specifically, although the reference magnetic data memory 38 stores the reference magnetic data obtained in the case where the coins 1 pass through the magnetic sensor 28 along the guide member 6*b* in the desired manner and outputs the reference magnetic data of the denomination discriminated by the denomination discriminating means 36 to the discriminating means 37 based upon the denomination discriminating signal input from the denomination discriminating means 36, the magnetic data output from the magnetic data memory 32 are output to the magnetic data correcting means 80. The magnetic data correcting means 80 stores correction coefficients Y experimentally determined in advance in accordance with the position at which the coins 1 pass through the magnetic sensor 28 and selects a desired correction coefficient Y based upon the coin passing position discriminating signal input from the coin passing position discriminating means 60 thereby, to correct the magnetic data input from the magnetic data memory 32 and then output to the discriminating means 37.

Therefore, in this embodiment, similarly to the embodiments shown in FIGS. 7 and 8, it is possible to discriminate the denominations, currency and the like of the coins 1 with high accuracy even in the case where the coins 1 are not transported in the desired manner.

As described above with reference to the preferred embodiments, according to the present invention, it is possible to provide a coin discriminating and counting apparatus which can be made small in size, discriminate the denominations, currency and the like of coins and count the value and/or the number of coins for respective denominations of coins with high accuracy.

The present invention has thus been shown and described with reference to specific embodiments. However, it should be noted that the present invention in no way limited to the details of the described arrangements but changes and modifications may be made without departing from the scope of the appended claims.

For example, in the above described embodiments, although only the number of coins of each denomination is counted, it is possible to count the value of coins for each denomination in addition to counting the number of coins or in place thereof.

Further, in the embodiments shown in FIGS. 7 to 9, although the coin transporting direction discriminating means 50 is not provided, it is possible for the coin transporting direction to be discriminated by further providing the coin transporting direction discriminating means 50 thereby to count the value and number of deposited coins of each denomination without fail.

Furthermore, in the above described embodiments, although the first control signal outputting means 33 and the second control signal outputting means 35 are provided and the start of storing operation for data, the stop of thereof, the discriminating operations and the like are controlled, these control operations may be carried out by a single control signal outputting means.

Moreover, in the above described embodiments, although the first control signal outputting means 33 respectively outputs the first and second timing signals when the sensor array 23 detects the optical data equal to the first predetermined value and the second control signal outputting means outputs the third timing signal when the sensor array detects the optical data equal to the second predetermined value less than the first predetermined value after it detected the first predetermined value once, the second predetermined value may be set equal to the first predetermined value so that the first timing signal is output when the sensor array 23 first detects the optical data equal to the first predetermined value thereby to cause the optical data memory 30 and the magnetic data memory 32 to start storing data and that afterward, the second timing signal is output when the sensor array 23 detects the optical data equal to the first predetermined value thereby to cause the optical data memory 30 and the magnetic data memory 32 to stop storing the data and cause the optical data memory 30 to output the optical data stored therein so as to start the discriminating operation.

Further, in the above described embodiments, although the sensor array 23 is disposed slightly upstream of the magnetic sensor 28, alternatively, the sensor array 23 may be disposed slightly downstream of the magnetic sensor 28. In the case where the sensor array 23 and the magnetic sensor 28 are disposed in the latter manner, the coin transporting direction discriminating means 50 is constituted so as to output a subtraction signal to the counter means 39 when the difference (M1–M2) between the magnetic data M1 and M2 is positive and an addition signal to the counter means 39 when the difference (M1–M2) between the magnetic data M1 and M2 is negative.

Furthermore, in the embodiment shown in FIG. 5, although the coin transporting direction is discriminated based upon the difference between the magnetic data M1 and the magnetic data M2, in place of the difference between the magnetic data M1 and M2, it is possible to discriminate the coin transporting direction based upon the ratio of the magnetic data M1 and M2.

Further, in the above described embodiments, coins of a number smaller than the predetermined number of coins to be wrapped are returned by reversely rotating the pulleys 7 and the rotatable disc 2 and are collected, they may be collected through the large coin collecting opening 19 by adjusting the space between the guide member 6*b* and the side face 12*d* of the guide block 12 or through the small coin collecting opening 18 by adjusting the diameter of thereof to an odd lot coin collecting box (not shown) without reversely rotating the pulleys 7 and the rotatable disc 2 or otherwise, they may be collected from the coin stacking apparatus to the fraction coin collecting box after they have been stacked in the coin stacking apparatus.

Furthermore, in the above described embodiments, although the sensor array 23 and the magnetic sensor 28 are disposed slightly offset with respect to the coin transporting direction, in cases where, as described above, the odd number of coins can be collected without reversely rotating the pulleys 7 and the rotatable disc 2 and there is no risk of jamming, or where as in the coin receiving machine, since after the denominations and currency of coins were discriminated and the value and number of deposited coins 1 were counted for each denomination, it is sufficient for them to be collected without being sorted, and since the coin passage 5 has not the bent portion 12 of the guide block 12 but is linearly arranged there is no risk of jamming and the pulleys 7 and the rotatable disc 2 are never reversely rotated, the sensor array 23 and the magnetic sensor 28 can be disposed at the same position with respect to the coin transporting direction.

Moreover, in the above described embodiments, although for wrapping coins 1 in the order of the number of the coins 1 of the respective denominations, prior to the wrapping operation, the space between the side face 12*d* of the guide block 12 and the guide member 6*b* is set smaller than the diameter of the smallest coin 1 so that after the denominations and currency of coins 1 were discriminated and the number of coins 1 for each denomination was counted by the sensor array 23 and the magnetic sensor 28, all coins 1 are caused to drop into the large coin collecting opening 19 and are collected, and then the wrapping operation of coins 1 is started, the space between the side face 12*d* of the guide block 12 and the guide member 6*b* may be set greater than the diameter of the largest coin 1 and the diameter of the small coin collecting opening 18 be adjusted greater than the diameter of the largest coin 1 so that all coins 1 are collected through the small coin collecting opening 18 and then the wrapping operation of coins 1 is started.

Further, in the present invention, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

I claim:

1. A coin discriminating and counting apparatus comprising a coin transporting means for transporting coins in a coin passage, a light emitting means disposed linewise in the direction perpendicular to the coin transporting direction on one side of the coin passage with respect to the vertical direction, a sensor array disposed so as to be opposite to said light emitting means on the other side of the coin passage, a magnetic sensor means for detecting magnetic properties of coins, said magnetic sensor means being disposed so that said coin passage and said sensor array are disposed therebetween with respect to the vertical direction, an optical data memory means for storing optical data detected by said sensor array, a magnetic data memory means for storing magnetic data detected by said magnetic sensor means, a coin diameter detecting means for detecting diameters of coins based upon the optical data stored in said optical data memory means, outputting coin diameter detection signals to said magnetic memory means thereby to enable the magnetic memory means to output to a discriminating means the magnetic data detected when the diameter of coins was detected and simultaneously outputting said coin diameter detection signals to a denomination discriminating means thereby to enable the denomination discriminating means to discriminate the denominations and currency of coins and outputting denomination discriminating signals to a reference magnetic data memory means and the discriminating means, and for the reference magnetic data memory means to store reference magnetic data for respective denominations and outputting the reference magnetic data to said discriminating means in accordance with denomination discriminating signals from said denomination discriminating means, and for the discriminating means to finally discriminate the denominations and currency of coins based upon said denomination discriminating signals output from said denomination discriminating means, said magnetic data output from said magnetic data memory means and said reference magnetic data output from said reference magnetic data memory means, and a counter means for calculating and storing the number of coins for respective denominations based upon discriminating signals output from said discriminating means.

2. A coin discriminating and counting apparatus in accordance with claim 1 wherein said sensor array and said magnetic sensor means are disposed offset with respect to the direction of said coin passage and a coin transporting direction discriminating means is further provided for discriminating the direction of coins transported and a control means for, when said sensor array detects optical data equal to a first predetermined value, enabling said optical data memory means to start storing the optical data input from said sensor array and simultaneously enabling said magnetic data memory means to start storing the magnetic data input from said magnetic sensor means as well as to output magnetic data M1 input from said magnetic sensor means at that time to said coin transporting direction discriminating means and when the sensor array detects the optical data equal to the first predetermined value again, enabling the optical data memory means to stop storing the optical data and simultaneously enabling the magnetic data memory means to stop storing the magnetic data as well as to output magnetic data M2 input from said magnetic sensor means at that time to said coin transporting direction discriminating means and when said sensor array detects the optical data equal to a second predetermined value not greater than the first predetermined value after it detected the optical data equal to the first predetermined value once, enabling said coin diameter detecting means to start detecting the coin diameter and enabling said coin transporting direction discriminating means to discriminate the coin transporting direction by comparing the magnitude between the magnetic data M1 and M2 input from said magnetic data memory means and output the result of discrimination to said counter means.

3. A coin discriminating and counting apparatus in accordance with claim 2 wherein said coin transporting direction discriminating means is constituted so that in the case where the sensor array is disposed upstream of said magnetic sensor means, it outputs an addition signal to said counter means when M1 is greater than M2 and outputs a subtraction signal to said counter means when M1 is smaller than M2 and on the other hand, in the case where the sensor array is disposed downstream of said magnetic sensor means, it outputs the addition signal to said counter means when M1 is smaller than M2 and outputs the subtraction signal to said counter means when M1 is greater than M2, thereby to causes said counter means to carry out an adding operation or a subtracting operation of the value and/or number of coins, while when M1 is equal to M2, it outputs a discrimination stop signal to said discriminating means irrespective of a positional relationship between said sensor array and said magnetic sensor means, thereby to cause said discriminating means to stop a coin discriminating operation.

4. A coin discriminating and counting apparatus in accordance with claim 1 which further includes a coin passing position detecting means for detecting, based upon the optical data stored in said optical data memory means, the position with respect of the widthwise direction of the coin passage where the coin passes between said light emitting means and said sensor array and outputting a coin passing position detection signal to said reference magnetic data memory means and wherein said reference magnetic data memory means stores reference magnetic data for respective denominations obtained in accordance with the position with respect to the widthwise direction of the coin passage where the coin passes and outputs the reference magnetic data selected based upon the denomination discriminating signal from said denomination discriminating means and the coin passing position detection signal from said coin passing position detecting means to said discriminating means.

5. A coin discriminating and counting apparatus in accordance with claim 2 which further includes a coin passing position detecting means for detecting, based upon the optical data stored in said optical data memory means, the position with respect of the widthwise direction of the coin passage where the coin passes between said light emitting means and said sensor array and outputting a coin passing position detection signal to said reference magnetic data memory means and wherein said reference magnetic data memory means stores reference magnetic data for respective denominations obtained in accordance with the position with respect to the widthwise direction of the coin passage where the coin passes and outputs the reference magnetic data selected based upon the denomination discriminating signal from said denomination discriminating means and the coin passing position detection signal from said coin passing position detecting means to said discriminating means.

6. A coin discriminating and counting apparatus in accordance with claim 3 which further includes a coin passing position detecting means for detecting, based upon the optical data stored in said optical data memory means, the position with respect of the widthwise direction of the coin passage where the coin passes between said light emitting means and said sensor array and outputting a coin passing position detection signal to said reference magnetic data memory means and wherein said reference magnetic data memory means stores reference magnetic data for respective denominations obtained in accordance with the position with respect to the widthwise direction of the coin passage where the coin passes and outputs the reference magnetic data selected based upon the denomination discriminating signal from said denomination discriminating means and the coin passing position detection signal from said coin passing position detecting means to said discriminating means.

7. A coin discriminating and counting apparatus in accordance with claim 1 which further includes a coin passing position detecting means for detecting, based upon the optical data stored in said optical data memory means, the position with respect of the widthwise direction of the coin passage where the coin passes between said light emitting means and said sensor array and a reference magnetic data correcting means for correcting the reference magnetic data output from said reference magnetic data memory means based upon a coin passing position detection signal output from said coin passing position detecting means thereby to output the thus corrected reference magnetic data to said discriminating means.

8. A coin discriminating and counting apparatus in accordance with claim 2 which further includes a coin passing position detecting means for detecting, based upon the optical data stored in said optical data memory means, the position with respect of the widthwise direction of the coin passage where the coin passes between said light emitting means and said sensor array and a reference magnetic data correcting means for correcting the reference magnetic data output from said reference magnetic data memory means based upon a coin passing position detection signal output from said coin passing position detecting means thereby to output the thus corrected reference magnetic data to said discriminating means.

9. A coin discriminating and counting apparatus in accordance with claim 3 which further includes a coin passing position detecting means for detecting, based upon the optical data stored in said optical data memory means, the position with respect of the widthwise direction of the coin passage where the coin passes between said light emitting means and said sensor array and a reference magnetic data correcting means for correcting the reference magnetic data output from said reference magnetic data memory means based upon a coin passing position detection signal output from said coin passing position detecting means thereby to output the thus corrected reference magnetic data to said discriminating means.

10. A coin discriminating and counting apparatus in accordance with claim 1 which further includes a coin passing position detecting means for detecting, based upon the optical data stored in said optical data memory means, the position with respect of the widthwise direction of the coin passage where the coin passes between said light emitting means and said sensor array and a magnetic data correcting means for correcting the magnetic data output from said magnetic data memory means based upon a coin passing position detection signal output by said coin passing position detecting means thereby to output the thus corrected magnetic data to said discriminating means.

11. A coin discriminating and counting apparatus in accordance with claim 2 which further includes a coin passing position detecting means for detecting, based upon the optical data stored in said optical data memory means, the position with respect of the widthwise direction of the coin passage where the coin passes between said light emitting means and said sensor array and a magnetic data correcting means for correcting the magnetic data output from said magnetic data memory means based upon a coin passing position detection signal output by said coin passing position detecting means thereby to output the thus corrected magnetic data to said discriminating means.

12. A coin discriminating and counting apparatus in accordance with claim 3 which further includes a coin passing position detecting means for detecting, based upon the optical data stored in said optical data memory means, the position with respect of the widthwise direction of the coin passage where the coin passes between said light emitting means and said sensor array and a magnetic data correcting means for correcting the magnetic data output from said magnetic data memory means based upon a coin passing position detection signal output by said coin passing position detecting means thereby to output the thus corrected magnetic data to said discriminating means.

13. A coin discriminating and counting apparatus in accordance with claim 1 wherein said sensor array and said magnetic sensor means are disposed offset with respect to the direction of said coin passage and a coin transporting direction discriminating means is further provided for discriminating the direction of coins transported and a control means for, when said sensor array detects optical data equal to a first predetermined value, enabling said optical data memory means to start storing the optical data input from said sensor array and simultaneously enabling said magnetic data memory means to start storing the magnetic data input from said magnetic sensor means as well as to output magnetic data M1 input from said magnetic sensor means at that time to said coin transporting direction discriminating means and when the sensor array detects the optical data equal to the first predetermined value again, enabling the optical data memory means to stop storing the optical data and simultaneously enabling the magnetic data memory means to stop storing the magnetic data as well as to output magnetic data M2 input from said magnetic sensor means at that time to said coin transporting direction discriminating means and when said sensor array detects the optical data equal to a second predetermined value not greater than the first predetermined value after it detected the optical data equal to the first predetermined value once, enabling said coin diameter detecting means to start detecting the coin diameter and enabling said coin transporting direction discriminating means to discriminate the coin transporting direction by comparing the magnitude between the magnetic data M1 and M2 input from said magnetic data memory means and output the result of discrimination to said discriminating means.

14. A coin discriminating and counting apparatus in accordance with claim 13 wherein said coin transporting direction discriminating means is constituted so that in the case where the sensor array is disposed upstream of said magnetic sensor means, it output an addition signal to said counter means when M1 is greater than M2 and outputs a subtraction signal to said counter means when M1 is smaller than M2 and on the other hand, in the case where the sensor array is disposed downstream of said magnetic sensor means, it outputs the addition signal to said counter means when M1 is smaller than M3 and outputs the subtraction signal to said counter means when M1 is greater than M2, thereby to cause said counter means to carry out an adding operation or a subtracting operation of the value and/or number of coins, while when M1 is equal to M2, it outputs a discrimination stop signal to said discriminating means irrespective of a positional relationship between said sensor array and said magnetic sensor means, thereby to cause said discriminating means to stop a coin discriminating operation.

15. A coin discriminating and counting apparatus in accordance with claim 13 which further includes a coin passing position detecting means for detecting, based upon the optical data stored in said optical data memory means, the position with respect of the widthwise direction of the coin passage where the coin passes between said light emitting means and said sensor array and outputting a coin passing position detection signal to said reference magnetic data memory means and wherein said reference magnetic data memory means stores reference magnetic data for respective denominations obtained in accordance with the position with respect to the widthwise direction of the con passage where the coin passes and outputs the reference magnetic data selected based upon the denomination discriminating signal from said denomination discriminating means and the coin passing position detection signal from said coin passing position detecting means to said discriminating means.

16. A coin discriminating and counting apparatus in accordance with claim 14 which further includes a coin passing position detecting means for detecting, based upon the optical data stored in said optical data memory means, the position with respect of the widthwise direction of the coin passage where the coin passes between said light emitting means and said sensor array and outputting a coin passing position detection signal to said reference magnetic data memory means and wherein said reference magnetic data memory means stores reference magnetic data for respective denominations obtained in accordance with the position with respect to the widthwise direction of the coin passage where the coin passes and outputs the reference magnetic data selected based upon the denomination discriminating signal from said denomination discriminating means and the coin passing position detection signal from said coin passing position detecting means to said discriminating means.

17. A coin discriminating and counting apparatus in accordance with claim 13 which further includes a coin passing position detecting means for detecting, based upon the optical data stored in said optical data memory means, the position with respect of the widthwise direction of the coin passage where the coin passes between said light emitting means and said sensor array and a reference magnetic data correcting means for correcting the reference magnetic data output from said reference magnetic data memory means based upon a coin passing position detection signal output from said coin passing position detecting means thereby to output the thus corrected reference magnetic data to said discriminating means.

18. A coin discriminating and counting apparatus in accordance with claim 14 which further includes a coin passing position detecting means for detecting, based upon the optical data stored in said optical data memory means, the position with respect of the widthwise direction of the coin passage where the coin passes between said light emitting means and said sensor array and a reference magnetic data correcting means for correcting the reference magnetic data output from said reference magnetic data memory means based upon a coin passing position detection signal output from said coin passing position detecting means thereby to output the thus corrected reference magnetic data to said discriminating means.

19. A coin discriminating and counting apparatus in accordance with claim 13 which further includes a coin passing position detecting means for detecting, based upon the optical data stored in said optical data memory means, the position with respect of the widthwise direction of the coin passage where the coin passes between said light emitting means and said sensor array and a magnetic data correcting means for correcting the magnetic data output from said magnetic data memory means based upon a coin passing position detection signal output by said coin passing position detecting means thereby to output the thus corrected magnetic data to said discriminating means.

20. A coin discriminating and counting apparatus in accordance with claim 14 which further includes a coin passing position detecting means for detecting, based upon the optical data stored in said optical data memory means, the position with respect of the widthwise direction of the coin passage where the coin passes between said light emitting means and said sensor array and a magnetic data correcting means for correcting the magnetic data output from said magnetic data memory means based upon a coin passing position detection signal output by said coin passing position detecting means thereby to output the thus corrected magnetic data to said discriminating means.

* * * * *